United States Patent [19]

Wappling

[11] 4,176,619

[45] Dec. 4, 1979

[54] PAPER SURFACE TREATING DEVICE

[75] Inventor: Rune A. Wäppling, Sundsvall, Sweden

[73] Assignee: Sca Development Aktiebolag, Sundsvall, Sweden

[21] Appl. No.: 861,344

[22] Filed: Dec. 16, 1977

[30] Foreign Application Priority Data

Dec. 21, 1976 [SE] Sweden ..... 7614343

[51] Int. Cl.[2] ..... B05C 5/02

[52] U.S. Cl. ..... 118/410

[58] Field of Search ..... 118/410, 249, 411, 412; 354/317

[56] References Cited

U.S. PATENT DOCUMENTS

| | | | |
|---|---|---|---|
| 894,976 | 8/1908 | O'Donnell | 118/249 X |
| 2,681,637 | 6/1954 | Simpson | 118/63 X |
| 3,919,974 | 11/1975 | Herzog | 118/410 |

FOREIGN PATENT DOCUMENTS

| | | | |
|---|---|---|---|
| 1558489 | 1/1969 | France | 118/410 |

*Primary Examiner*—John McIntosh

*Attorney, Agent, or Firm*—Lerner, David, Littenberg & Samuel

[57] ABSTRACT

A device is provided for applying a fluid surface treatment agent to a paper web that includes a container for receiving the fluid surface treatment agent to be applied. The container includes a gap which is mounted for contact with the paper web for transferring the fluid from the container to the paper web. A rotary brush is positioned opposite the gap and on the other side of the paper web, and includes fluffy surfaces for applying pressure to the paper web to press the paper web into contact with the fluid applying gap. The position and pressure of the brush are adjustable, and a casing is provided to at least partially surround the brush to produce a fan effect on the paper web as the brush rotates relative thereto.

3 Claims, 1 Drawing Figure

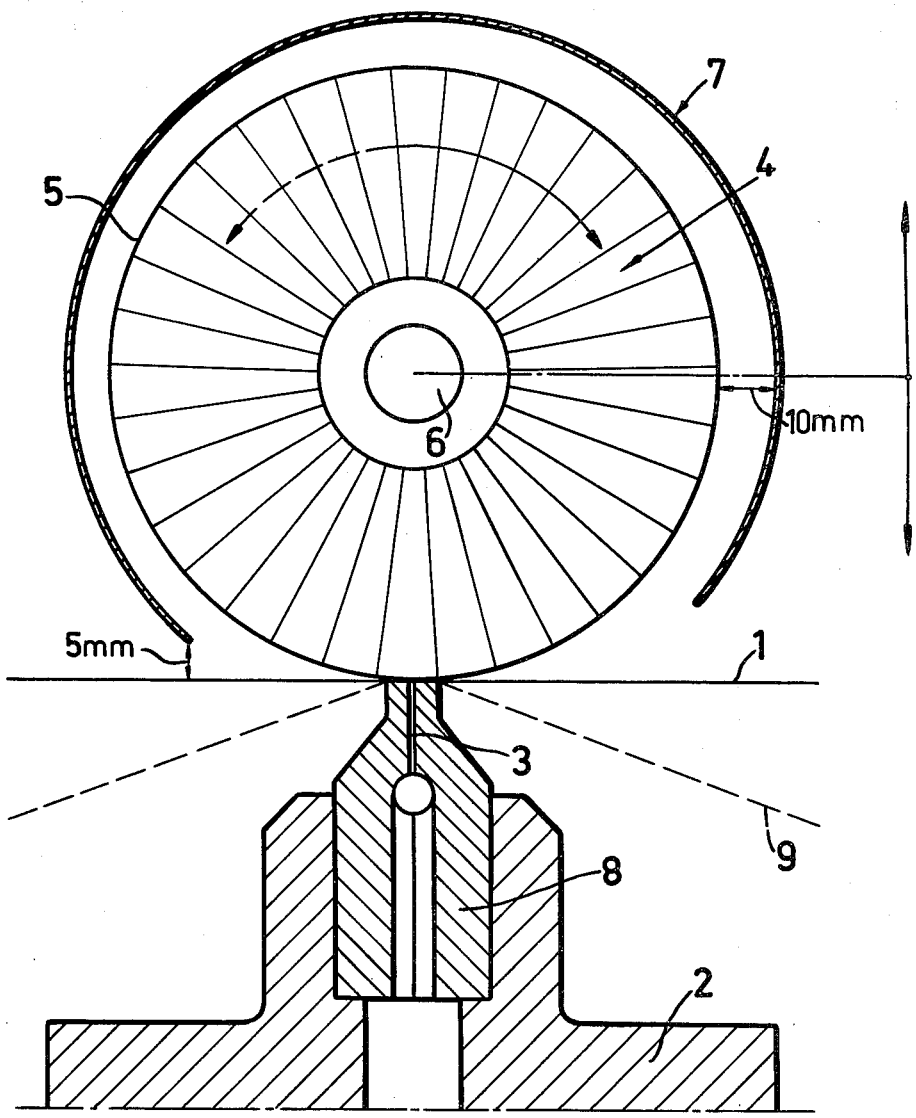
7
4
5
10mm
6
5mm
1
3
9
8
2

PAPER SURFACE TREATING DEVICE

FIELD OF THE INVENTION

The present invention relates generally to devices for the surface treatment of paper, and specifically to a device for applying a fluid surface treatment agent to a paper web wherein a rotary brush is employed to apply pressure to one side of the paper web, while the other side of the paper web receives the fluid agent.

BACKGROUND OF THE INVENTION

Paper surface treating devices are well-known in the art, and reference is made to U.S. Pat. No. 3,941,902 for a full disclosure of such apparatus. Typically, a container having a discharge slot or gap applies the treating fluid to a paper web. The discharge slot or gap aperture is usually formed by two spaced parallel guide bars, so that the surface treatment agent flows from the container through the space between the guide bars and on to the paper web, as the paper web is passing over the edges or surfaces of the guide bars. In such arrangements, it is preferable that the paper web be directed away from the gap at an oblique angle relative to an imaginary plane in parallel with the flow direction of the paper web, the oblique angle being illustrated by dotted line 9 in FIG. 1 of the drawings.

It has been found that such arrangements have certain drawbacks. For example, since the discharge slot or gap is formed by two parallel guide bars, the upper surfaces, edges, and corners which are in contact with the paper web are of great importance with respect to the proper functioning of the gap, since the amount of fluid agent to be applied to the paper web depends on the web speed and on controlling the dispensing of the fluid agent from the gap. Therefore, it is important that these surfaces and edges be well defined and not be highly subject to wear. However, this is a difficult problem since the upper surfaces and edges of the guide bars are subjected to a great deal of wear by the paper web. Moreover, the amount of wear or friction can be substantial if the fluid agent being applied includes a pigment, such as may be found in different types of coating agents. Under such circumstances, the edges and surfaces of the guide bars in contact with the paper web are rapidly worn and rounded, which thereby affects the so-called secondary gap, i.e., the space between the paper web and the upper edge of the rearwardly located guide bar. Accordingly, it would be highly desirable to provide an arrangement wherein the paper web moves in a substantially horizontal plane over the guide bars and gap, and in parallel with the upper surface of the guide bars.

Accordingly, it is an object of the present invention to provide an improved arrangement which overcomes the aforesaid problems. Specifically, it is within the contemplation of the present invention to provide a gap arrangement which substantially increases the life of the guide bars, and also allows the pressure applied thereto to be regulated and controlled.

SUMMARY OF THE INVENTION

In accordance with the principles of the present invention, a device is provided for applying a fluid surface treatment agent to a paper web which includes a container for receiving the fluid surface treatment agent to be applied. The container includes guide bars forming a gap which is adapted to be mounted in contact with the paper web so that the gap transfers the agent from the container to the paper web. A rotary brush is positioned opposite the gap on the other side of the paper web and rotates relative to the paper web. The rotary brush includes fluffy or relatively soft surfaces for applying pressure to the paper web to press the paper web into contact with the fluid applying gap. Additionally, the rotary brush is adjustable with respect to its position and the amount of pressure it applies to the paper web and the guide bars forming the gap. Moreover, a casing is provided and at least partially surrounds the brush to produce a fan effect on the paper web as the brush rotates.

Advantageously, as a result of the present invention, the guide bars forming the gap are subjected to a substantially uniform wear or friction, which thereby increases the life of the guide bars. In addition, the pressure applied by the rotary brush to the paper web may be easily controlled and varied. This makes it possible to reduce, when desired, the size of the coating applied to the paper web, and to apply a coat thereto independent of the speed of the paper web relative to the guide bars. Finally, as a result of the present invention, non-uniform strokes are eliminated from the paper web.

BRIEF DESCRIPTION OF THE DRAWING

Further objects, features, and advantages of the present invention will become apparent upon the consideration of the following detailed description of the presently preferred embodiment, when taken in conjunction with the accompanying FIGURE, which illustrates a device employing the principles of the present invention.

DETAILED DISCUSSION OF PREFERRED EMBODIMENTS OF THE INVENTION

Referring to the drawing, there is shown a device embodying principles of the present invention, and includes a container 2 for receiving the fluid surface treatment agent which can be applied to the paper web 1. The surface treatment agent may be in a solvent, or dispersed state, and supplied to container 2 by appropriate feeding means (not shown).

The container 2 includes guide bars 8 which define therebetween a fluid applying gap 3, which also is referred to herein as a discharge slot 3, for discharging the treatment fluid from the container 2 to paper web 1, as the paper web passes over the guide bars 8. The container 2 and guide bars 8 extend in a transverse direction relative to the paper web 1, and extend substantially across the entire width of the paper web. As is apparent from the drawing, the paper web 1 passes over the gap 3 and guide bars 8 in a substantially horizontal direction.

In accordance with the invention, a rotary brush 4 is positioned opposite to the gap 3 and on the other side of the paper web 1 and is mounted for rotation relative to the paper web. The rotary brush 4 extends in a transverse direction across the entire transverse width of the paper web, and is mounted for rotation about axle 6. The rotary brush 4 applies pressure to the web 1 and presses it against guide bars 8 and in contact with fluid applying gap 3. The peripheral surface 5 of the brush is in contact with the web, and the surface of the brush is relatively soft and fluffy. Accordingly, as the brush 4 rotates relative to the paper web, the pressure is applied to it by the fluffy surfaces 5.

In addition, a casing 7 at least partially surrounds the brush 4 so that the brush produces a fan effect on an air stream on the paper web as it rotates relative thereto.

Further, the rotary brush 4 is provided with suitable apparatus for adjusting the position and pressure of the rotary brush relative to the paper web 1. This is diagrammatically illustrated by the line extending radially outward from axis 6 to arrows indicating the vertical adjustment of the axis 6 relative to the paper web 1.

While the invention has been described with a certain degree of particularity, it will be understood that the description was by way of example only and that numerous variations and modifications, as may become apparent to those of ordinary skill in the art, can be made without departing from the spirit and the scope of the invention as hereinafter claimed.

What is claimed is:

1. A device for applying a fluid surface treatment agent to a paper web, comprising:

a container for receiving said fluid surface treatment agent to be applied to said paper web;

said container including two spaced guide bars forming a fluid applying gap adapted to be disposed in contact with said paper web for applying said fluid surface treatment agent from said container to said paper web;

means for moving said paper web over said guide bars substantially parallel to the upper surfaces of said guide bars;

a rotary brush positioned opposite said container for rotation relative to said paper web;

said rotary brush including soft and fluffy peripheral surfaces for applying pressure to said paper web to press said paper web into contact with said fluid applying gap as said paper web receives said fluid surface treatment agent therefrom, and means for adjusting the position and pressure of said rotary brush relative to said paper web to vary the thickness of the coating applied to said paper web independent of the speed of said moving paper web.

2. A device in accordance with claim 1 wherein the axis of said rotary brush extends in the direction of said gap, and the pressure applying surfaces of said rotary brush extend the entire length of said brush.

3. A device in accordance with claim 1 further including a casing at least partially surrounding said rotary brush to produce a fan effect on said paper web as said rotary brush rotates.

* * * * *